US008714727B2

(12) United States Patent
Torigoe et al.

(10) Patent No.: US 8,714,727 B2
(45) Date of Patent: May 6, 2014

(54) LIQUID EJECTING APPARATUS

(75) Inventors: Yasuhide Torigoe, Matsumoto (JP); Hiroshi Miyazawa, Okaya (JP); Takayuki Iijima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 26 days.

(21) Appl. No.: 13/605,825

(22) Filed: Sep. 6, 2012

(65) Prior Publication Data

US 2013/0057627 A1 Mar. 7, 2013

(30) Foreign Application Priority Data

Sep. 7, 2011 (JP) ..... 2011-194662

(51) Int. Cl.
*B41J 2/01* (2006.01)

(52) U.S. Cl.
USPC ..... 347/102; 347/101

(58) Field of Classification Search
None
See application file for complete search history.

(56) References Cited

U.S. PATENT DOCUMENTS

| | | | | |
|---|---|---|---|---|
| 5,406,316 | A | 4/1995 | Schwiebert et al. | |
| 6,390,618 | B1 * | 5/2002 | Wotton et al. | 347/102 |
| 7,661,789 | B2 * | 2/2010 | Shimizu | 347/22 |

FOREIGN PATENT DOCUMENTS

| | | |
|---|---|---|
| JP | 07-017037 | 1/1995 |
| JP | 2005-059478 | 3/2005 |
| JP | 2006-175645 | 7/2006 |

* cited by examiner

*Primary Examiner* — Geoffrey Mruk
(74) *Attorney, Agent, or Firm* — Workman Nydegger

(57) ABSTRACT

A liquid ejecting apparatus includes: a support portion including a support surface that supports a target; a liquid ejecting head that ejects a liquid onto the target supported by the support surface, from a position opposed to the support surface; a housing portion that includes the support portion in a wall portion opposed to the liquid ejecting head and that is formed in a location so that an air suction port that takes in air from the exterior is further from the liquid ejecting head than the support surface in a direction that is orthogonal to the support surface; and an air exhaust unit that exhausts air from the interior of the housing portion.

5 Claims, 4 Drawing Sheets

LIQUID EJECTING APPARATUS

BACKGROUND

1. Technical Field

This application claims priority to Japanese Patent Application No. 2011-194662 filed on Sep. 7, 2011. The entire disclosure of Japanese Patent Application No. 2011-194662 is hereby incorporated herein by reference.

The present invention relates to liquid ejecting apparatuses that eject a liquid onto a target.

2. Related Art

Thus far, ink jet printers that form images by ejecting a liquid from a liquid ejecting head onto a recording medium such as paper have been known as one type of liquid ejecting apparatus. Among such printers, there are printers that include fixing units that fix ink (the liquid) that has landed on the medium by heating that ink in order to form images (for example, JP-A-2006-175645).

The printer disclosed in JP-A-2006-175645 includes a drawing unit case that encloses a drawing unit in which drawing operations are carried out on the recording medium by an ink jet head (liquid ejecting head), and the fixing unit is provided on the outer side of the drawing unit case. Accordingly, the ink jet head housed within the drawing unit case is suppressed from being heated by the heat produced by the fixing unit.

In addition, openings that serve as an entry port and a discharge port, respectively, for the recording medium are formed in the drawing unit case, and an outside air introduction unit that introduces air from the exterior into the drawing unit case via an outside air introduction port that is separate from the stated openings is connected to the drawing unit case. Accordingly, when air is introduced by the outside air introduction unit into the drawing unit case from the outside air introduction port, an airflow is produced moving from the interior to the exterior of the drawing unit case, and air whose temperature has risen is exhausted from the drawing unit case to the exterior via the openings due to the airflow moving to the exterior.

However, with the stated printer, the air introduced into the drawing unit case from the exterior by the outside air introduction unit produces the airflow within the drawing unit case, and thus an airflow is also produced in a space where the ink jet head and the recording medium face each other during recording. This airflow can influence the accuracy of the flight of the ink (liquid) ejected from the ink jet head toward the recording medium. Accordingly, although the ink jet head can be suppressed from being heated, there is also a risk that the quality of the image formed on the recording medium by the ink jet head will drop.

SUMMARY

It is an advantage of some aspects of the invention to provide a liquid ejecting apparatus capable of suppressing a liquid ejecting head from being heated while also suppressing a drop in the accuracy of the flight of liquid from the liquid ejecting head.

A liquid ejecting apparatus according to the invention includes: a support portion including a support surface that supports a target; a liquid ejecting head that ejects a liquid onto the target supported by the support surface, from a position opposed to the support surface; a housing portion that includes the support portion in a wall portion opposed to the liquid ejecting head and that is formed in a location so that an air suction port that takes in air from the exterior is further from the liquid ejecting head than the support surface in a direction that is orthogonal to the support surface; and an air exhaust unit that exhausts air from the interior of the housing portion.

According to this configuration, the air exhaust unit causes heat to be dissipated from the support portion and cools the support portion by exhausting the air within the housing portion that has been heated by the heat dissipated from the support portion. As a result, the cooled support portion indirectly cools the liquid ejecting head through the air present between the support surface and the liquid ejecting head, which suppresses the liquid ejecting head from being heated. Note that in the case where the air is sucked into the housing portion through the air suction port due to the air exhaust operations of the air exhaust unit, the air suction port is formed in a location that is further from the liquid ejecting head than the support surface of the support portion, and thus the air sucked into the housing portion through the air suction port is suppressed from producing an airflow between the liquid ejecting head and the support surface of the support portion. Accordingly, a drop in the accuracy of the flight of the liquid from the liquid ejecting head toward the target supported on the support surface of the support portion caused by the air exhaust operations of the air exhaust unit is suppressed. It is thus possible to suppress the liquid ejecting head from being heated while also suppressing a drop in the accuracy of the flight of the liquid from the liquid ejecting head.

In addition, the liquid ejecting apparatus according to the invention further includes a heating unit, provided downstream from the support portion in a transport direction of the target, and heats the target; the housing portion includes an air exhaust port through which the air is exhausted by the air exhaust unit, and the air exhaust port is disposed downstream from the air suction port in the transport direction.

According to this configuration, the air exhaust port that exhausts the air using the air exhaust unit is provided downstream in the transport direction of the target as seen from the air suction port, and thus the comparatively cool air on the upstream in the transport direction, which is on the opposite side as the heating unit in the transport direction, is sucked into the housing portion from the air suction port. Accordingly, the housing portion and the support portion provided in the housing portion can be efficiently cooled.

In addition, in the liquid ejecting apparatus according to the invention, an upstream-side air suction port is provided, as the air suction port, upstream from the support portion in the transport direction of the target.

According to this configuration, comparatively cool air is sucked into the housing portion through the upstream-side air suction port provided on the opposite side of the heating unit in the transport direction of the target as seen from the support portion. Accordingly, the housing portion and the support portion provided in the housing portion can be even more efficiently cooled.

In addition, in the liquid ejecting apparatus according to the invention, the support portion is disposed on a straight line that connects the upstream-side air suction port and the air exhaust port.

According to this configuration, the support portion is disposed in the flow path of the air sucked into the housing portion through the upstream-side air suction port due to the air exhaust operations of the air exhaust unit. Accordingly, comparatively cool air sucked into the housing portion from the upstream-side air suction port is blown against the support portion, which makes it possible to more efficiently cool the support portion contained within the housing portion.

In addition, the liquid ejecting apparatus according to the invention further includes a suction unit that sucks the target positioned on the support surface by sucking the interior of a suction hole provided in the support surface of the support portion from the opposite side as the support surface.

According to this configuration, in the case where the target is not located upon the support surface of the support portion, the air that accumulates between the liquid ejecting head and the support surface of the support portion is sucked by the suction unit due to the suction operations of the suction unit, which suppresses the liquid ejecting head from being heated with certainty. Meanwhile, in the case where the target is located upon the support surface of the support portion, the opening formed in the support surface by the suction hole is blocked by the target. Accordingly, when liquid is ejected from the liquid ejecting head toward the target, almost no air is sucked within the housing portion through the suction hole, which suppresses an airflow from being produced between the liquid ejecting head and the support surface of the support portion. It is thus possible to suppress the liquid ejecting head from being heated with even more certainty while also suppressing a drop in the accuracy of the flight of the liquid from the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a specific embodiment of an ink jet printer, serving as a type of a liquid ejecting apparatus according to the invention, will be described with reference to FIGS. 1 through 7.

Figure 1:
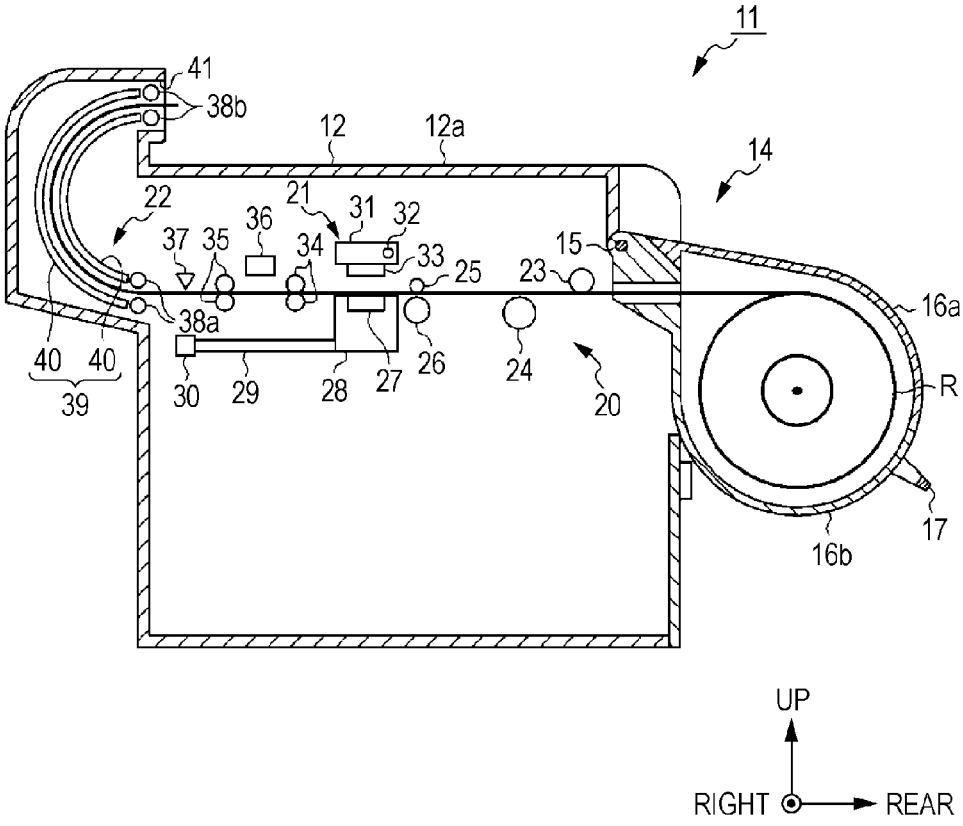
FIG. 1 is a general cross-sectional view illustrating a printer according to an embodiment of the invention.

As shown in FIG. 1, a box-shaped apparatus main body 12 of a printer 11 that serves as the liquid ejecting apparatus is formed so that its upper surface 12*a* is an approximately rectangular plane-shape that follows the horizontal direction. Meanwhile, a roll member housing unit 14 is attached to the rear side of the apparatus main body 12 in a freely-rotatable state using a rotating shaft 15. The roll member housing unit 14 includes an upper case portion 16*a* formed in a box shape that opens downward, and a lower case portion 16*b* formed in a box shape that opens upward. The two case portions 16*a* and 16*b* make contact with each other, forming a housing space within the roll member housing unit 14 that houses a roll member R in which a sheet S, serving as an elongated target, is wrapped up into a roll shape. In addition, a handle portion 17 is provided on a rear end of the lower case portion 16*b* so as to extend rearward.

A transport unit 20, a printing unit 21, and a paper discharge unit 22 are provided within the apparatus main body 12. A plurality of transport rollers 23 through 26 are provided in the transport unit 20 so as to follow a transport path of the sheet S. These transport rollers 23 through 26 transport the sheet S, which is unwound and let out from the roll member R within the roll member housing unit 14, toward the printing unit 21.

A support plate 27, which has a support surface (the top surface in FIG. 1) capable of supporting the sheet S unwound and transported from the roll member R, is provided in the printing unit 21. The support plate 27 is attached to an upper wall portion of a housing portion 28 made from a metal material, and the support surface configures part of the surface of the upper wall portion. A suction fan 30, serving as an air exhaust unit, is connected to the housing portion 28 via an air exhaust tube 29. In addition, a carriage 31 is provided in a location that opposes the support surface of the support plate 27 in the vertical direction. The carriage 31 is supported in a freely-mobile manner above the support plate 27 by a guide shaft 32 that extends in the width direction (the horizontal direction in FIG. 1) that is orthogonal to a transport direction of the sheet S. The carriage 31 is configured so as to be capable of being moved back and forth along the shaft line direction of the guide shaft 32 by a driving unit (not shown). Furthermore, a recording head 33 that serves as a liquid ejecting head is supported on the bottom surface of the carriage 31, and a plurality of nozzles (not shown) for ejecting ink are formed in the bottom surface of the recording head 33. By ejecting ink onto the sheet S transported between the recording head 33 and the support plate 27, the recording head 33 carries out a printing process on the sheet S.

In addition, a heater unit 36, serving as a heating unit that carries out a drying process by blowing warm air on the sheet S on which the printing process has been carried out, is provided in the printing unit 21 downstream from the support plate 27 in the transport path of the sheet S and between transport roller pairs 34 and 35.

Furthermore, a cutter 37, capable of cutting the sheet S along the width direction (horizontal direction) orthogonal to the transport direction, is provided in the printing unit 21 in a position in the transport path of the sheet S that is downstream from the heater unit 36. The sheet S is then cut by the cutter 37 into single sheets from the continuous sheet state.

The paper discharge unit 22 includes transport roller pairs 38*a* and 38*b* that apply, to the sheet S that has been cut into single sheets by the cutter 37 in the printing unit 21, a transport force directed downstream in the transport direction, and an inverting unit 39 that inverts the sheet S to which the transport force has been applied by the transport roller pairs 38*a* and 38*b*. The inverting unit 39 is configured from two guide plates 40 that have an approximate arc shape when viewed cross-sectionally, and the guide plates 40 are disposed so as to be parallel with a gap provided therebetween. A curved inversion path is formed between the two guide plates 40. The transport roller pair 38*a* is disposed in a location near the upstream end of the inversion path formed in the inverting unit 39, whereas the transport roller pair 38*b* is disposed in a location near the downstream end of the inversion path formed in the inverting unit 39. Note that an upper end portion of the inverting unit 39 is located further upward than the upper surface 12*a* of the apparatus main body 12.

The sheet S on which the printing process has been carried out by the recording head 33 is transported downstream and made its front/rear surfaces inverted by passing through the inversion path in the inverting unit 39. The inverted sheet S is then discharged from a discharge port 41, which is located on the front side of the apparatus main body 12 and further upward than the upper surface 12*a*, toward the rear side of the apparatus main body 12, on which the roll member housing unit 14 is also located. Note that the sheet S discharged from the discharge port 41 is placed upon the upper surface 12*a* of the apparatus main body 12 with its printed surface, on which the ink has landed, facing downward.

Next, the configurations of the support plate 27 and the housing portion 28 will be described.

Figure 2:
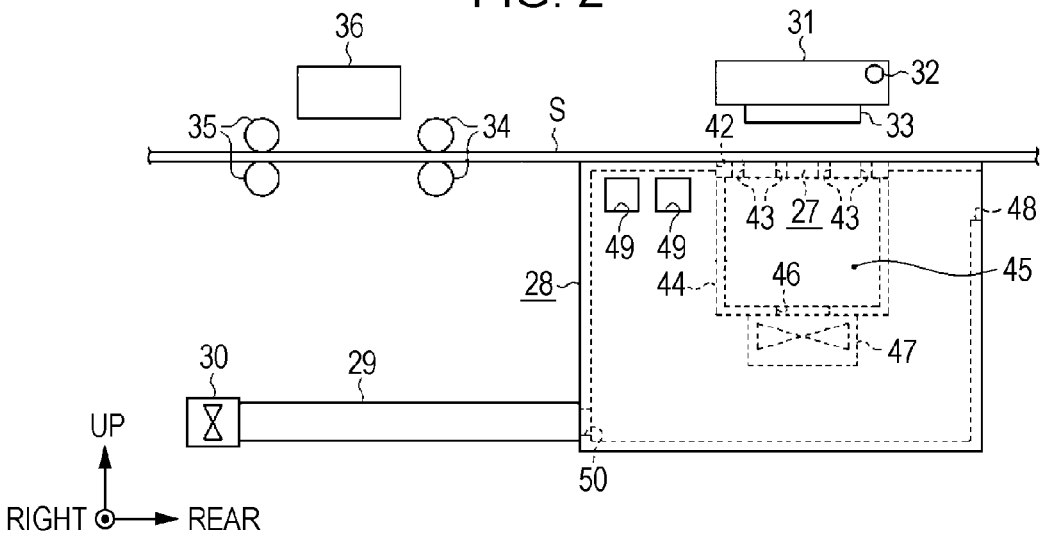
FIG. 2 is a side view illustrating a printing unit according to the embodiment.
Figure 3:
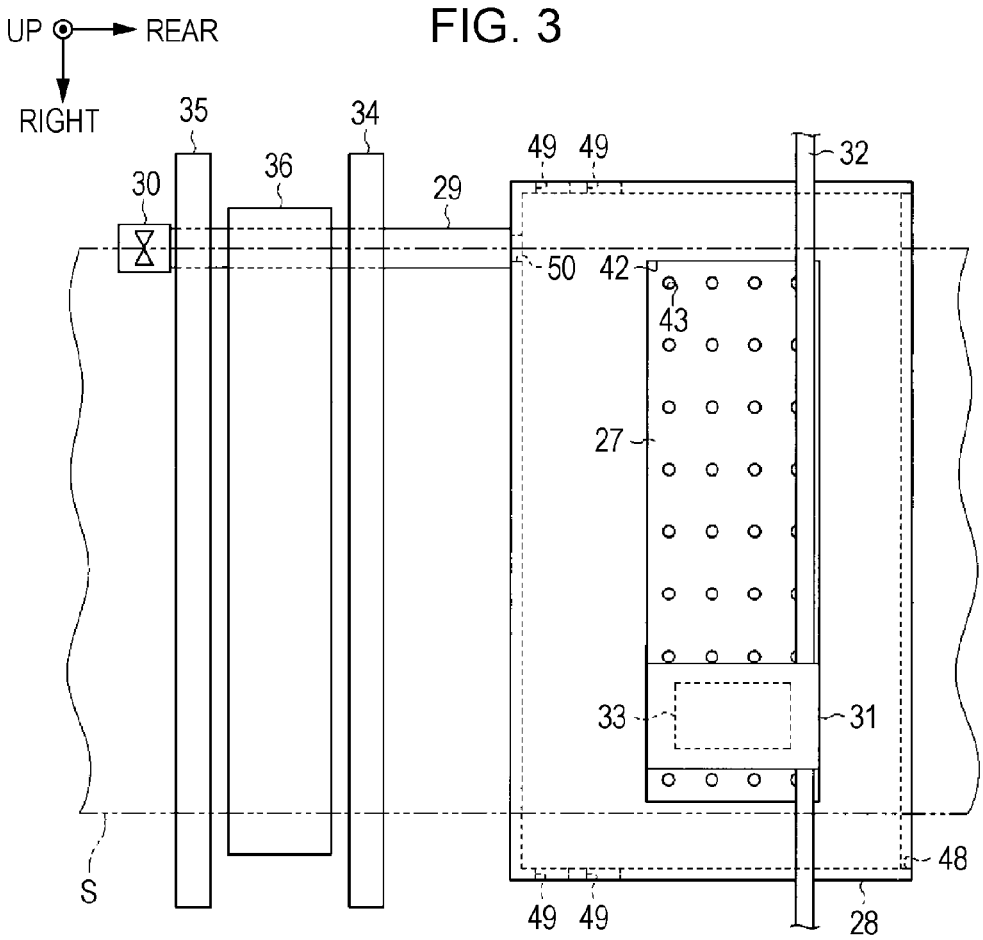
FIG. 3 is a plan view illustrating the printing unit according to the embodiment.

As shown in FIGS. 2 and 3, the support plate 27 is attached to an opening portion 42, provided in the upper wall portion of the housing portion 28, that passes through, from top to bottom, in a region opposed to the region in which the recording head 33 moves. The opening portion 42 of the housing portion 28 has approximately the same shape as the support plate 27 when viewed from above. Accordingly, the inner edges of the opening portion 42 and the outer edges of the support plate 27 are in tight contact with essentially no gap therebetween. In addition, the support surface of the support plate 27 is flush with the upper surface (front surface) of the upper wall portion of the housing portion 28, and thus the support surface of the support plate 27 configures part of the surface of the housing portion 28.

Multiple suction holes 43 that pass through the support plate 27 in the thickness direction, or from top to bottom, thereof are formed in the support surface of the support plate 27. In addition, a flow path formation member 44 having a closed-ended quadrangular box-shape is disposed on the bottom surface side of the support plate 27 with its open end making contact with the bottom surface of the support plate 27. The flow path formation member 44 is formed having a size that can be contained within the housing portion 28. In this embodiment, a support portion that supports the sheet S is configured from the support plate 27 and the flow path formation member 44. Note that because the flow path formation member 44 and the support plate 27 have essentially the same shape when viewed from above, and because the open end of the flow path formation member 44 makes contact with the outer edges of the bottom surface of the support plate 27, a space region 45 that is enclosed between the bottom surface of the support plate 27 and the flow path formation member 44 is formed.

In addition, an opening portion 46 that connects the interior/exterior of the space region 45 is formed in the center of the bottom surface of the flow path formation member 44, and a suction fan 47 is provided so as to cover the opening portion 46. The suction fan 47 is also formed having a size that can be contained within the housing portion 28 along with the flow path formation member 44. Then, when negative pressure is produced within the suction holes 43 by the interior of the space region 45 in the flow path formation member 44 being sucked through the opening portion 46 due to the suction fan 47 being driven, the sheet S is sucked onto the support surface of the support plate 27 due to the negative pressure being produced. In other words, the suction fan 47 functions as a suction unit that sucks the sheet S located on the support surface by sucking the interior of the suction holes 43 provided in the support surface of the support plate 27 from the opposite side as the support surface.

Note that a rear wall portion of the housing portion 28 is lower in height than left and right side wall portions of the housing portion 28 and a front wall portion of the housing portion 28. Accordingly, an air suction port 48, serving as an upstream-side air suction port that spans across the entire horizontal direction of the housing portion 28, is formed between the upper end of the rear wall portion of the housing portion 28 and the upper wall portion of the housing portion 28, and the interior/exterior of the housing portion 28 communicate via the air suction port 48.

Meanwhile, quadrangular air suction ports 49 that connect the interior/exterior of the housing portion 28 are formed in the left and right side wall portions of the housing portion 28, in locations that are downstream from the support plate 27 in the transport path of the sheet S and that are lower than the support surface of the support plate 27. In other words, the air suction ports 49 are located between the support plate 27 and the heater unit 36 in the transport direction of the sheet S. In this embodiment, two air suction ports 49 each are formed in locations toward the top of the left and right side wall portions of the housing portion 28. The respective air suction ports 49 in the side wall portions are formed at the same height with spaces provided therebetween in the front/back direction, which corresponds to the transport direction of the sheet S.

In addition, an air exhaust port 50 that connects the interior/exterior of the housing portion 28 is formed toward the left in the front wall portion of the housing portion 28. This air exhaust port 50 is located in the vicinity of the bottom surface of the housing portion 28. The flow path formation member 44 contained within the housing portion 28 is located on a straight line that connects the air exhaust port 50 and the air suction port 48 of the housing portion 28. Furthermore, one end of the air exhaust tube 29 is connected to the housing portion 28 so as to cover the air exhaust port 50 from the outside of the housing portion 28. In other words, an air exhaust channel formed within the air exhaust tube 29 communicates with the interior of the housing portion 28 via the air exhaust port 50. Meanwhile, the other end of the air exhaust tube 29 is connected to the suction fan 30, and the suction fan 30 is located downstream from the heater unit 36 in the transport direction of the sheet S. When the suction fan 30 is driven, the air within the housing portion 28 is sucked through the air exhaust tube 29, and the air sucked by the suction fan 30 is exhausted to the exterior of the apparatus main body 12.

Next, operations of the printer 11 configured as above will be described, with a particular focus placed on operations occurring when the suction fan 30 takes in the air within the housing portion 28 through the air suction ports 48 and 49.

Figure 4:
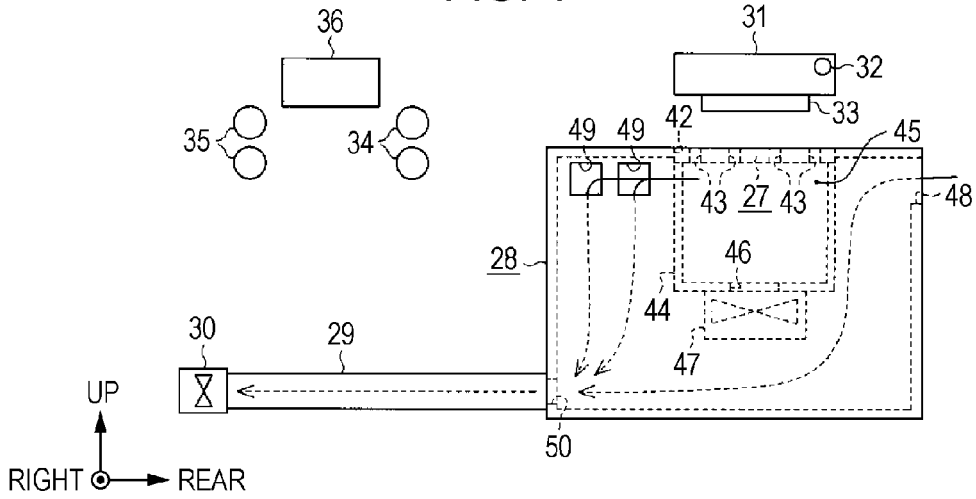
FIG. 4 is a side view illustrating a flow of air through an air suction port in the printing unit.
Figure 5:
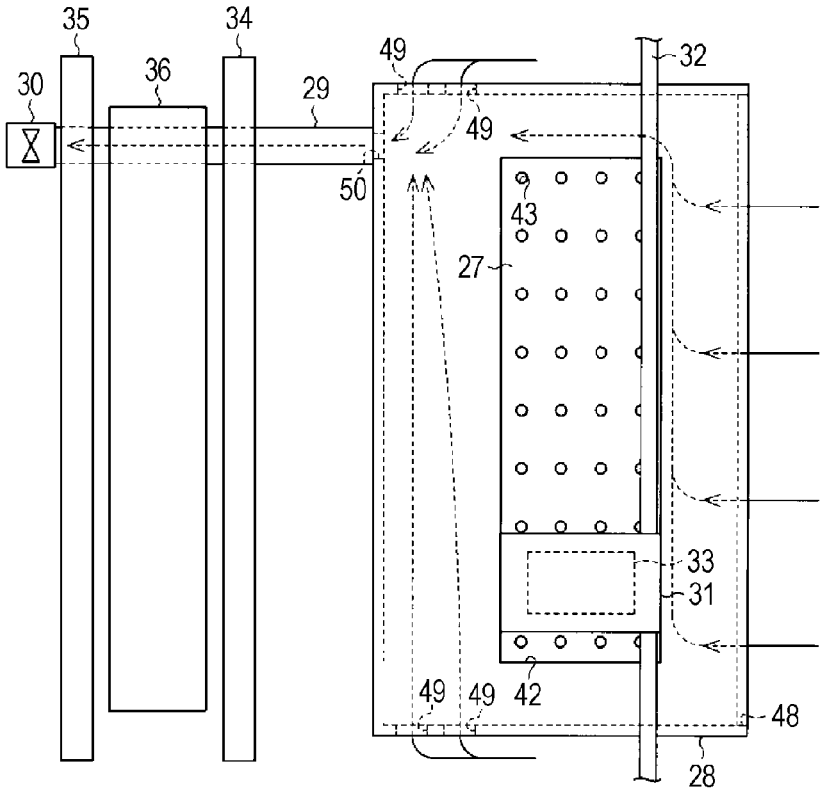
FIG. 5 is a plan view illustrating a flow of air through the air suction port in the printing unit.

As shown in FIGS. 4 and 5, when the suction fan 30 operates, the suction fan 30 exhausts the air from within the housing portion 28 through the air exhaust tube 29. Upon doing so, air is taken into the housing portion 28 through the air suction ports 48 and 49 on the downstream side of the housing portion 28. As indicated by the dotted lines in FIGS. 4 and 5, an airflow moving from the air suction ports 48 and 49 toward the air exhaust port 50 is produced within the housing portion 28.

Here, in this embodiment, the support plate 27 and the heater unit 36 are disposed so as to be adjacent in the transport direction of the sheet S. Accordingly, the air in the region on the downstream side of the support plate 27 in the transport direction, where the heater unit 36 is disposed, is heated. The air heated by the heater unit 36 flows upstream in the transport direction of the sheet S and reaches the vicinity of the location where the support plate 27 is disposed.

In this case, in this embodiment, the air suction port 48 faces a space region on the opposite side as the heater unit 36 with the support plate 27 therebetween. The air taken into the housing portion 28 through the air suction port 48 is comparatively cooler than the air taken into the housing portion 28 through the air suction ports 49. As a result, the flow path formation member 44 is efficiently cooled by the comparatively cool air that is blown thereagainst, and thus heat transfer from the support plate 27 to the flow path formation member 44 can be fostered. Accordingly, the recording head 33 is caused to dissipate heat to the support plate 27 through the space region between the recording head 33 and the support plate 27. As a result, the recording head 33 is indirectly cooled by the support plate 27, which makes it possible to suppress the recording head 33 from being heated.

In addition, the air suction ports 49 is provided upstream from the air exhaust port 50 in the transport direction of the sheet S. Accordingly, it is easy to take in air upstream from the air suction ports 49 in the transport direction through the air suction ports 49, and the air taken into the housing portion 28 is cooler than the air heated by the heater unit 36 downstream from the air suction ports 49. As a result, the housing portion 28 and the flow path formation member 44 are efficiently cooled by the comparatively cool air taken into the housing portion 28, and thus the heat transfer from the support plate 27 to the flow path formation member 44 can be fostered. Accordingly, the recording head 33 is caused to dissipate heat to the support plate 27 through the space region between the recording head 33 and the support plate 27. As a result, the recording head 33 is indirectly cooled by the support plate 27, which makes it possible to suppress the recording head 33 from being heated.

In addition, the air suction port 48 and the air suction ports 49 are formed so as to be lower than the support surface of the support plate 27. Accordingly, the air taken into the housing portion 28 through the air suction port 48 and the air suction ports 49 produces almost no airflow in the space region between the nozzle formation surface of the recording head 33 and the support surface of the support plate 27. As a result, the operation of the suction fan 30 is suppressed from influencing the accuracy of the flight of the ink ejected from the recording head 33 toward the sheet S that is supported on the support surface of the support plate 27.

Furthermore, in this embodiment, the flow path formation member 44 is disposed on a straight line that connects the air suction port 48 and the air exhaust port 50 when viewed from the side, as shown in FIG. 4. In addition, as shown in FIG. 5, the air suction port 48 is open across the horizontal direction of the housing portion 28, including the area that is, when viewed from above, located at the opposing corner of the air exhaust port 50 with the flow path formation member 44 provided therebetween. Accordingly, an airflow traveling from the air suction port 48 toward the air exhaust port 50 blows against the flow path formation member 44 within the housing portion 28, which causes heat to be dissipated from the flow path formation member 44. In addition, the air that has been heated by the heat dissipated from the flow path formation member 44 is exhausted from the interior of the housing portion 28 through the air exhaust port 50 after flowing along the side surface of the flow path formation member 44.

Figure 6:
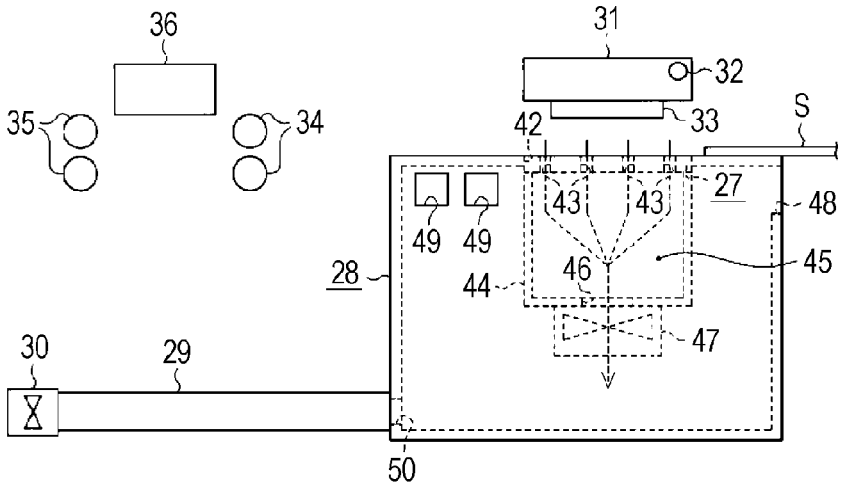
FIG. 6 is a side view illustrating the printing unit prior to suction holes in a support plate being blocked.

Incidentally, as shown in FIG. 6, in a state in which the leading end (downstream end) of the sheet S that has been let out from the roll member R immediately after the roll member R has been replaced has not yet reached the support surface of the support plate 27, the space region 45 within the flow path formation member 44 communicates with the space region between the recording head 33 and the support plate 27 through the suction holes 43. Accordingly, the suction fan 47 sucks air into the space region 45 within the flow path formation member 44 from the space region between the recording head 33 and the support plate 27 through the suction holes 43. As a result, even if some of the comparatively hot air that flows from the heater unit 36 toward the support plate 27 reaches the space region between the recording head 33 and the support plate 27, that air is suppressed from accumulating in the space region between the recording head 33 and the support plate 27. Accordingly, the recording head 33 is suppressed from being heated by the air that flows from the heater unit 36 toward the support plate 27.

Figure 7:
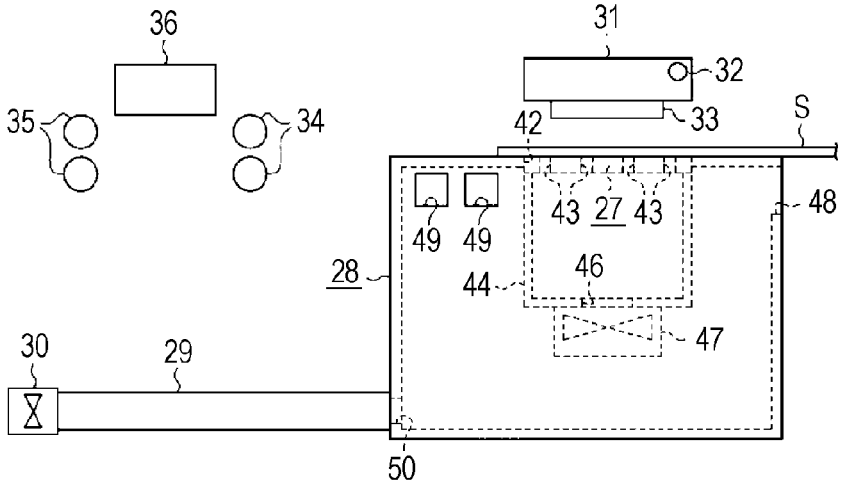
FIG. 7 is a side view illustrating the printing unit after the suction holes in the support plate are blocked.

In addition, as shown in FIG. 7, when the leading end of the sheet S let out from the roll member R reaches the support surface of the support plate 27, the openings of the suction holes 43 in the support surface of the support plate 27 are blocked by the sheet S. Accordingly, even if the suction fan 47 is operating, almost no air is sucked into the space region 45 within the flow path formation member 44 from the space region between the recording head 33 and the support plate 27. As a result, the operation of the suction fan 47 has almost no influence on the accuracy of the flight of the ink ejected from the recording head 33 toward the sheet S that is supported on the support surface of the support plate 27.

According to the embodiment described thus far, the following effects can be achieved.

1. By exhausting the air within the housing portion 28 that has been heated by the heat dissipated from the support plate 27, the suction fan 30 causes heat to be dissipated from the support plate 27, which cools the support plate 27. As a result, the cooled support plate 27 indirectly cools the recording head 33 through the air present between the support surface and the recording head 33, which suppresses the recording head 33 from being heated. Note that the air is sucked within the housing portion 28 through the air suction ports 48 and 49 of the housing portion 28 due to the air exhaust operations of the suction fan 30. In this case, because the air suction ports 48 and 49 are formed in a location that is further from the recording head 33 than the support surface of the support plate 27, the air sucked into the housing portion 28 through the air suction ports 48 and 49 is suppressed from producing an airflow between the recording head 33 and the support surface of the support plate 27. Accordingly, a drop in the accuracy of the flight of the ink from the recording head 33 toward the sheet S supported on the support surface of the support plate 27 caused by the air exhaust operations of the suction fan 30 is suppressed. It is thus possible to suppress the recording head 33 from being heated while also suppressing a drop in the accuracy of the flight of the ink from the recording head 33.

2. Comparatively cooler air than that downstream from the upstream side of the air suction ports 49 is sucked into the housing portion 28 through the air suction ports 49 disposed upstream from the air exhaust port 50 in the transport direction of the sheet S. Accordingly, the housing portion 28 and the support plate 27 contained within the housing portion 28 can be efficiently cooled.

3. Comparatively cool air is sucked into the housing portion 28 through the air suction port 48 disposed on the opposite side as the heater unit 36 in the transport direction of the sheet S when viewed from the support plate 27. Accordingly, the housing portion 28 and the support plate 27 contained within the housing portion 28 can be even more efficiently cooled.

4. The flow path formation member 44 is disposed in the flow path of the air sucked into the housing portion 28 through the air suction port 48 due to the air exhaust operations of the suction fan 30. Accordingly, comparatively cool air sucked into the housing portion 28 from the air suction port 48 is blown against the flow path formation member 44, which makes it possible to more efficiently cool the support plate 27 contained within the housing portion 28.

5. In the case where the sheet S is not located upon the support surface of the support plate 27, the air that accumulates between the recording head 33 and the support surface of the support plate 27 is sucked by the suction fan 47 due to the suction operations of the suction fan 47, which suppresses the recording head 33 from being heated with certainty. Meanwhile, in the case where the sheet S is located upon the support surface of the support plate 27, the openings formed in the support surface by the suction holes 43 are blocked by the sheet S. Accordingly, when ink is ejected from the recording head 33 toward the sheet S, almost no air is sucked within the housing portion 28 through the suction holes 43, which suppresses an airflow from being produced between the recording head 33 and the support surface of the support plate 27. It is thus possible to suppress the recording head 33 from being heated with more certainty while also suppressing a drop in the accuracy of the flight of the ink from the recording head 33.

The aforementioned embodiment may be changed to the embodiments described hereinafter as well.

In the stated embodiment, the configuration may be such that the suction fan 47 that holds the sheet S on the support surface of the support plate 27 is omitted and the suction holes 43 provided in the support surface of the support plate 27 are omitted.

In the stated embodiment, the rear wall portion of the housing portion 28 may be formed so as to have the same height as the left and right side wall portions of the housing portion 28 and the front wall portion of the housing portion 28, and the air suction port 48 may be formed so as to pass through the rear wall portion of the housing portion 28. In this case, the air suction port 48 may be formed in any desired location in the rear wall portion of the housing portion 28. In addition, the air suction port 48 may be formed in the left and right side wall portions of the housing portion 28, or may be formed in the front wall portion of the housing portion 28. However, it is desirable for the flow path formation member 44 to be located on a straight line connecting the air suction port 48 and the air exhaust port 50.

In the stated embodiment, the air suction ports 49 may be formed on the upstream side or the same location of the support plate 27 in the transport direction of the sheet S in both the side walls of the housing portion 28.

In the stated embodiment, the air suction ports 49 may be formed in the front wall portion of the housing portion 28.

In the stated embodiment, the housing portion 28 may be configured so that one of the air suction port 48 located upstream from the support plate 27 in the transport direction of the sheet S and the air suction ports 49 located downstream from the support plate 27 in the transport direction of the sheet S is omitted.

In the stated embodiment, it is not absolutely necessary for the heater unit 36 to be provided in a location that is adjacent to the support plate 27 in the transport direction of the sheet S. Furthermore, the configuration may be such that the heater unit 36 is omitted. In these configurations, although comparatively hot air does not flow from the heater unit 36 toward the support plate 27, it is possible that the recording head 33 will be heated due to heat produced by the carriage 31. Even in such a case, heat can be caused to be dissipated from the support plate 27 toward the flow path formation member 44 by the suction fan 30 causing heat to be dissipated from the flow path formation member 44 by sucking the air from within the housing portion 28. As a result, the recording head 33 can be suppressed from being heated by the support plate 27 indirectly cooling the recording head 33.

In the stated embodiment, it is not absolutely necessary for the support plate 27 to configure part of the surface of the housing portion 28, and, for example, the configuration may be such that the support surface of the support plate 27 protrudes upward beyond the upper surface of the upper wall portion of the housing portion 28.

In the stated embodiment, the heating unit is not limited to a configuration that sends warm air toward the sheet S, and may instead employ a configuration that heats the sheet S by radiantly heating the sheet S. The configuration is not limited to the case for performing a drying process, and may be for controlling the temperature of the sheet S.

In the stated embodiment, a full line-type line head that spans the entirety of the width direction of the sheet S may be employed as the liquid ejecting head.

In the stated embodiment, the target is not limited to an elongated target wrapped in roll form, and a single sheet-form target may be employed instead.

In the above embodiment, the liquid ejecting apparatus is embodied as the ink jet printer 11, but a liquid ejecting apparatus that ejects or expels another liquid aside from ink may serve as the embodiment instead. The invention can also be applied in various types of liquid ejecting apparatuses including liquid ejecting heads that eject minute liquid droplets. Note that "droplet" refers to the state of the liquid ejected from the liquid ejecting apparatus, and is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in its liquid state, including liquids having high or low viscosity, fluid states such as, sol, gel water, other inorganic agents, inorganic agents, liquid solutions, liquid resins, and liquid metals (metallic melts); furthermore, other liquids in addition to liquids as a single state of a matter, liquids in which the molecules of a functional material composed of a solid matter such as pigments, metal particles, or the like are dissolved, dispersed, or mixed in a liquid carrier are included as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. The following are specific examples of liquid ejecting apparatuses: liquid ejecting apparatus that eject liquids including materials such as electrode materials, coloring materials, and so on in a dispersed or dissolved state for use in the manufacture and so on of, for example, liquid-crystal displays, EL (electroluminescence) displays, front emission displays, and color filters; liquid ejecting apparatuses that eject bioorganic matters used in the manufacture of biochips; liquid ejecting apparatuses that eject liquids to be used as samples for precision pipettes; printing equipment and microdispensers; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatus that eject an etching liquid such as an acid or alkali onto a substrate or the like for etching. The invention can be applied to any type of these liquid ejecting apparatuses.

What is claimed is:

1. A liquid ejecting apparatus comprising:

a main apparatus housing;

a support portion including a support surface that supports a target;

a liquid ejecting head that ejects a liquid onto the target supported by the support surface, from a position opposed to the support surface, the liquid ejecting head being enclosed by the main apparatus housing;

a housing portion that is enclosed within the main apparatus housing and includes the support portion in a wall portion opposed to the liquid ejecting head and that is formed in a location so that an air suction port of the housing portion that takes in air from an area enclosed by the main apparatus housing is further from the liquid ejecting head than the support surface in a direction that is orthogonal to the support surface; and an air exhaust unit that exhausts air from an interior of the housing portion.

2. The liquid ejecting apparatus according to claim 1, further comprising:

a heating unit, provided downstream from the support portion in a transport direction of the target, and heats the target;

wherein the housing portion includes an air exhaust port through which the air is exhausted by the air exhaust unit; and the air exhaust port is disposed downstream from the air suction port in the transport direction.

3. The liquid ejecting apparatus according to claim 2, wherein an upstream-side air suction port is provided, as the air suction port, upstream from the support portion in the transport direction of the target.

4. The liquid ejecting apparatus according to claim 3, wherein the support portion is disposed on a straight line that connects the upstream-side air suction port and the air exhaust port.

5. The liquid ejecting apparatus according to claim 1, further comprising:

a suction unit that sucks the target positioned on the support surface by sucking the interior of a suction hole provided in the support surface of the support portion from the opposite side as the support surface.

* * * * *